US006205730B1

(12) United States Patent
Hasan et al.

(10) Patent No.: US 6,205,730 B1
(45) Date of Patent: Mar. 27, 2001

(54) ROOFING PLATE FOR SECURING ROOFING MEMBRANE

(75) Inventors: Riaz Hasan, Palatine; Paul M. Larson, Hoffman Estates; Gareth A. Wallace, Palos Heights, all of IL (US)

(73) Assignee: Illinois Tool Works Inc, Glenview, IL (US)

( * ) Notice: Subject to any disclaimer, the term of this patent is extended or adjusted under 35 U.S.C. 154(b) by 0 days.

(21) Appl. No.: 09/229,925

(22) Filed: Jan. 13, 1999

(51) Int. Cl.[7] ..... E04B 7/00

(52) U.S. Cl. ..... 52/408; 52/410; 52/512; 52/506.05; 411/154; 411/147; 411/164

(58) Field of Search ..... 52/408, 410, 512, 52/506.05, 698, 515; 411/147, 154, 369, 533, 164, 151

(56) References Cited

U.S. PATENT DOCUMENTS

| | | |
|---|---|---|
| 4,545,270 | 10/1985 | Dewey . |
| 4,726,164 | 2/1988 | Reinwall et al. . |
| 4,751,802 | 6/1988 | Whitman . |
| 4,763,456 | 8/1988 | Giannuzzi . |
| 4,787,188 | 11/1988 | Murphy . |
| 4,799,845 | 1/1989 | Hrysko . |
| 4,852,323 | 8/1989 | Kartfilt . |
| 4,909,691 | 3/1990 | Bogel . |
| 4,945,699 | 8/1990 | Murphy . |
| 5,102,275 | 4/1992 | Hulsey . |
| 5,171,116 | 12/1992 | Gerhardt et al. . |
| 5,797,232 | 8/1998 | Larson . |

*Primary Examiner*—Christopher T. Kent
*Assistant Examiner*—Jennifer I. Thissell
(74) *Attorney, Agent, or Firm*—Lisa M. Soltis; Mark W. Croll; John P. O'Brien

(57) ABSTRACT

A roofing plate for securing a roofing membrane to a roof includes a top surface, a bottom surface and a generally oblong peripheral edge having two major sides and two minor sides. An opening is located generally centrally on the plate in a central portion for receiving a fastener for securing the plate to the roof, and a plurality of gripping formations are formed on the peripheral edge for preventing slippage of the roofing membrane relative to the plate. Also included are a pair of first rib portions which project from the top surface respectively along at least each of the two major sides between the peripheral edge and the central opening, and a pair of transverse ribs which project from the top surface for enhancing torsional stability and reinforcing the central portion of the plate.

28 Claims, 3 Drawing Sheets

ROOFING PLATE FOR SECURING ROOFING MEMBRANE

BACKGROUND OF THE INVENTION

The present invention relates generally to roofing plates for securing a water resistant roofing membrane to a roof deck, and specifically to a roofing plate configured and adapted to prevent such a roofing membrane from slipping out from underneath the roofing plate.

In certain modern roofing installations of commercial and factory buildings having a flat roof design, a layer of insulation is placed on a generally corrugated steel roof deck, and is then covered with a single ply thermoplastic roofing membrane to protect against the elements. A common method of securing the roofing membrane to the roof is to attach the edges of a long sheet of the membrane to the deck using fasteners passing through the insulation. The most common fastener is an elongated screw passing through a plate or washer. These fastener assemblies (screw plus plate) are placed at regular intervals along the membrane edge. Once a sheet of roofing membrane is thus secured, another sheet is laid parallel to, and with its edge overlapping, the edge of the already secured sheet. In this manner, the fastened plates are covered by the edge of the second membrane sheet in the overlapped region. Next, a heat gun is used to heat the top and bottom of the overlapping sheets to the melting point, and they are pressed together. As the membrane sheets cool, they become bonded together. This process is continued until the entire roof is covered with the roofing membrane.

It has been found that, because the membrane is exposed to the elements, it may at times be subject to high velocity winds blowing across the roof which cause uplift forces. These forces cause the membrane to billow upwardly. As this occurs, the membrane tends to pull up and exerts an upward force on one edge of the plate, which causes the plate to shift or rock backwards in the direction away from the force. Rocking prevents the fastener from being pulled out of the roof by alleviating this edge-directed force, but it also allows the membrane to slip from underneath the plate, and at a certain point, causes the membrane to tear around the fastener.

In commonly assigned U.S. Pat. No. 5,797,232 to Larson, the disclosure of which is incorporated by reference herein, a roofing plate is disclosed which, in conjunction with a fastener such as a screw, is adapted to "rock" onto its longitudinal sides, which are parallel to the edge of the roofing membrane, as the membrane billows upwardly, thereby alleviating stress on the head of the fastener. The Larson plate also has a generally oblong configuration which is adapted to distribute the load to a broader area to prevent the membrane from tearing, as one of the sides of the plate is pressed into the membrane as it rocks. Moreover, the broader two sides of the plate are provided with gripping formations, such as a series of notches, to grip the membrane as it rocks to prevent the membrane from slipping relative to the plate and tearing around the fastener.

While the oblong configuration of the Larson plate distributes stress along its longer sides and prevents the sides of the plate from cutting into and tearing the membrane, the corners of the plate concentrate a significant amount of stress on a small portion of the membrane as the membrane is uplifted, and consequently, weaken and tear the roofing membrane. Moreover, the longer sides of the Larson plate are adapted to be aligned parallel to the edge of the roofing membrane to distribute the load to a broader area, and to enable the gripping formations to grab the membrane when the membrane is uplifted. However, the plates often spin away from the required parallel alignment with the edge of the roofing membrane when the plate is being installed or when the plate is inadvertently kicked by an installer. Additionally, the Larson roofing plate is relatively expensive to manufacture due to its size, and thus disadvantageous from a commercial perspective.

Thus, it is a first object of the present invention to provide an improved roofing plate for attaching a roofing membrane to a roof that is relatively inexpensive to manufacture, and yet sufficiently strong to resist permanent bending and deformation.

Another object of the present invention is to provide such an improved roofing plate having elongated sides, but yet have corners that do not tear the roofing membrane.

Yet another object of the present invention is to provide such an improved roofing plate which is configured keep the plate in desired alignment with the edge of the roofing membrane.

SUMMARY OF THE INVENTION

The above-identified objects are met or exceeded by the present roofing plate for securing a membrane to a roof. In the preferred embodiment, the width of the roofing plate is relatively narrow to reduce material cost. To compensate for the narrowness of the plate, it is provided with a rib portion which is configured to increase the longitudinal strength of the plate. Also, the corners of the plate are flared upwardly to avoid cutting into the roofing membrane. The present plate also includes a pair of dimples which keep the longer sides of the plate from rotating away from a parallel alignment with the edge of the roofing membrane during installation.

More specifically, a roofing plate for attaching a roofing membrane to a roof has a top surface, a bottom surface and a generally oblong peripheral edge having two major sides and two minor sides. An opening is located generally centrally on the plate in a central portion for receiving a fastener for securing the plate to the roof, and a plurality of gripping formations are formed on the peripheral edge for preventing slippage of the roofing membrane relative to the plate. Also included are a pair of first rib portions which project from the top surface respectively along at least each of the two major sides between the peripheral edge and the central opening, and a pair of transverse ribs which project from the top surface for enhancing torsional stability and reinforcing the central portion of the plate.

Additionally, the roofing plate includes upwardly flared corners for preventing the peripheral edge at the corners from cutting the roofing membrane. The first rib portions may be connected to each other along the minor sides between the peripheral edge and the central opening to extend continuously along the peripheral edge. The connected first rib portions include a second rib portion projecting upwardly from the first rib portions along the central portion of the plate for assisting the first rib portions in preventing the plate from bending at the central portion.

BRIEF DESCRIPTION OF THE SEVERAL VIEWS OF THE DRAWINGS

The above-mentioned and other features of this invention and the manner of obtaining them will become more apparent, and will be best understood by reference to the following description, taken in conjunction with the accompanying drawings in which.

DESCRIPTION OF THE PREFERRED EMBODIMENT

Figure 1:
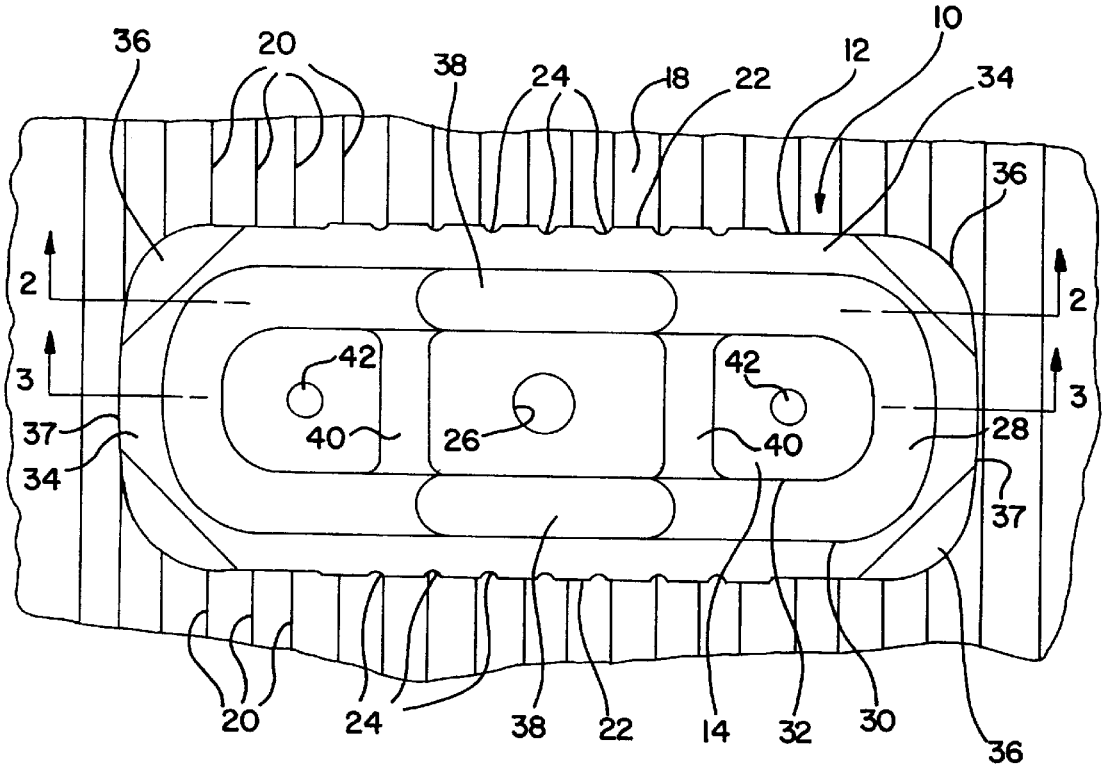
FIG. 1 is a top view of the roofing plate of the present invention, placed on top of a roofing membrane.
Figure 2:
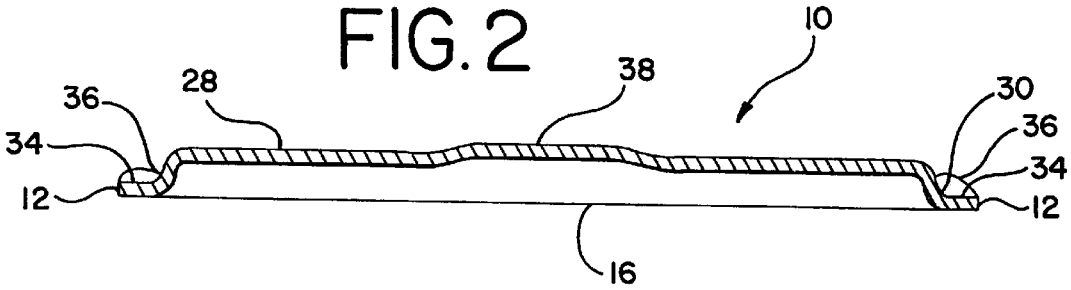
FIG. 2 is a sectional view taken along the line 2—2 in FIG. 1, without the membrane, and in the direction indicated generally.
Figure 3:
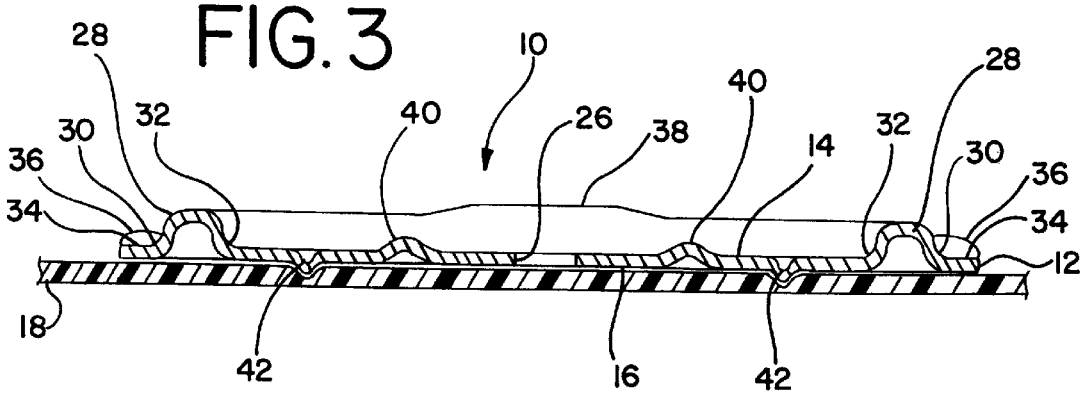
FIG. 3 is a sectional view taken along the line 3—3 in FIG. 1 and in the direction indicated generally.

Referring now to FIGS. 1–3, the roofing plate of the present invention is shown and indicated generally at 10. The roofing plate 10 is preferably stamped from a generally flat metal, and has an oblong peripheral edge 12 (best seen in FIG. 1). It has a top surface 14 and a bottom surface 16 which faces and rests directly on a conventional single ply roofing membrane 18 (best seen in FIG. 3). In the preferred embodiment, the length of the plate 10 is approximately 3¾ inches and the width is approximately 1½ inches. It is important to note that the preferred length of the plate 10 covers at least 12 reinforcing fibers 20, which are embedded in the roofing membrane 18 and spaced approximately ¼ inch apart, in order to obtain the necessary wind resistance strength.

Along the longer or major two sides 22 of the peripheral edge 12, a series of spaced gripping formations or notches 24 are formed on approximately 3 inch length centered about an opening 26, which is generally centrally located on the plate 10 (best seen in FIG. 1). Preferably, the notches 24 are ¼ inch apart. The notches 24 are configured to increase friction between the sides 22 of plate 10 and the membrane 18 to prevent the membrane from sliding out from underneath the plate. As such, the notches 24 should be deep enough to create a friction sufficient to prevent slippage, but not so deep as to cause tears in the membrane 18. In the preferred embodiment, the notches are approximately 0.015 inch deep. It is contemplated, however, that the orientation, number, shape, depth and spacing of the notches 24 may vary with the application, including, for example, file-like grooves arranged in parallel or checkered patterns.

The opening 26 is adapted to receive a fastener such as a screw or a bolt (not shown). The shank of the fastener should preferably be slightly smaller that the diameter of the opening to allow the plate 10 to rock with the membrane 18, thereby alleviating the some torsional force acting on the underside of the head of the fastener as the membrane reacts to the wind. In the preferred embodiment, the diameter of the opening is ¼ inch.

Formed between the opening 26 and the peripheral edge 12 is a primary rib 28, which when viewed from the top, defines an outer and an inner perimeter 30, 32, respectively. The primary rib 28 generally corresponds to the peripheral edge 12 (best seen in FIG. 1), and protrudes upwardly from the top surface 14, so that it is broadly convex when viewed from the top and concave when viewed from the bottom (best seen in FIG. 3). When force is exerted by the upwardly billowing membrane 18, the primary rib 28 provides added strength to the plate 10 to prevent it from bending and deforming.

On the outer perimeter 30 of the rib 28 is a lip 34 that extends from the outer perimeter to the peripheral edge 12 of the plate 10. In accordance with one important aspect of the present invention, the lip 34 at corners 36 of the plate 10, where the longer or major two sides 22 join the shorter or minor two sides 37 is bent upwardly, preferably at approximately 5 degrees. In this manner, the tendency of the corners 36 to cut into and tear the membrane 18 is effectively reduced. While five degrees is the preferred angle of the bend, the corners 36 can be bent from approximately 4 to 16 degrees. Within this range, the corners 36 are not so flat as to cut into to the membrane 18, and not bent to the extent that they lose contact with the membrane, or face upwardly enough to cut into the membrane placed on top of the plate.

In accordance with another important aspect of the present invention, in one embodiment the primary rib 28 is provided with a pair of secondary ribs 38 which extend on both sides of the opening 26 in the longitudinal direction. The secondary ribs 38 are preferably approximately ¾ inch long and are formed or "punched-up" from the primary rib 28 (best seen in FIGS. 2 and 3). As a result, the secondary ribs 38 are raised above and overlap a portion of the primary rib 28 but share the same outer and inner perimeters 30, 32 as the primary rib (best seen in FIG. 1). Having this configuration, the secondary ribs 38 provide additional longitudinal reinforcement, especially along the central portion of the plate 10, to give strength along the entire length of the plate. The ribs 38 help to keep the plate from "butterflying" or permanently deforming into a "V" shape when subjected to a high wind loading. The "V" shape would create a higher stress concentration in the center of the plate 10, resulting in premature failure of the membrane.

In addition to the secondary ribs 38, the plate 10 also includes a pair of cross or transverse ribs 40 (best seen in FIGS. 1 and 3), which extend transversely, one on each side of the opening 26, to connect with the primary rib 28. Similar to the primary rib 28, the cross ribs 40 protrude upwardly from the top surface 14, but to a height generally less than the height of the primary rib 28, which is preferably approximately ⅛ inch from the top surface. The cross ribs 40 provide torsional stability to the plate 10. They also reinforce the central portion of the plate to keep the central portion flat so it is not distorted as it is loaded by the underside of the head of the screw.

Yet another feature of the present invention is a pair of dimples 42 which are provided on opposite sides of the opening 26 in the longitudinal direction and within the two areas bounded by the primary rib 28 and the two cross ribs 40 (best seen in FIGS. 1 and 3). The dimples 42 protrude downwardly into a conical shape from the bottom surface 16, so that they resemble a dimple when viewed from the top and a cone from the bottom and the side. In the preferred embodiment, the dimples 42 protrude to a height of less than 1/16 inch and have a diameter at the base of approximately ⅛ inch. It is important to note that the dimples 42 have rounded tips so that the dimples may lightly grip the roofing membrane 18 without puncturing it (best seen in FIG. 3). In this manner, the dimples 42 keep the plate 10 from spinning as the fastener is drilled into the membrane and the underside of the head contacts the top surface of the plate and tends to rotate the plate, or if the plate is inadvertently kicked by an installer.

Figure 4:
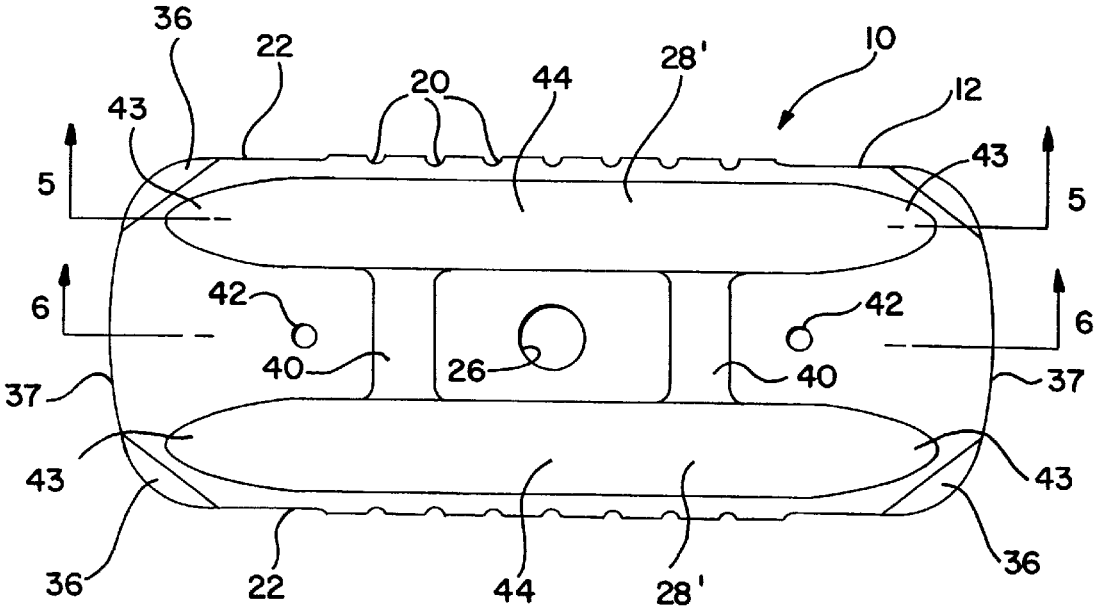
FIG. 4 is a top view of an alternate embodiment of the roofing plate of the present invention.
Figure 5:
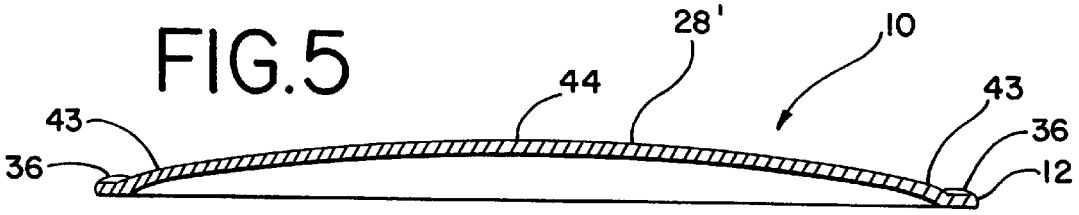
FIG. 5 is a sectional view taken along the line 5—5 in FIG. 4 and in the direction indicated generally.
Figure 6:
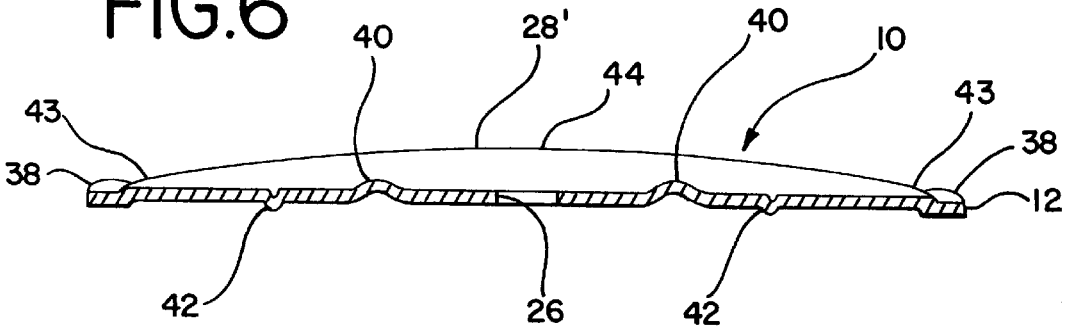
FIG. 6 is a sectional view taken along the line 6—6 in FIG. 4 and in the direction indicated generally.

Referring now to FIGS. 4–6, an alternate embodiment of the present roofing plate is shown. Features which are similar to the first embodiment have been identified with the same reference numerals as in the first embodiment and will not be further described, except as necessary for understanding the alternate embodiment. The roofing plate 10 of the alternate embodiment includes a pair of primary ribs 28' for providing added longitudinal strength to the plate 10 to prevent it from bending and deforming. Unlike the primary rib 28 of the first embodiment, which generally corresponds to the oblong shape of the peripheral edge 12, the primary ribs 28' extend only along and substantially the length of the two longer or major sides 22. Further, the primary ribs 28' also do not have secondary ribs 38 provided along the central portion of the plate 10 (best seen in FIGS. 1–3) for providing additional longitudinal reinforcement to keep the plate from "butterflying," as in the first embodiment. Instead, each of the primary ribs 28' has a gradually increasing height which increases from both ends 43, near the corners 36, to the middle portion 44 of the primary ribs 28' near the central opening 26 of the plate 10. This configuration in effect creates a higher rib in the central, higher stressed portion of the plate 10, and accordingly, is also effective in preventing the plate 10 from "butterflying" when subjected to a high wind loading.

Figure 7:
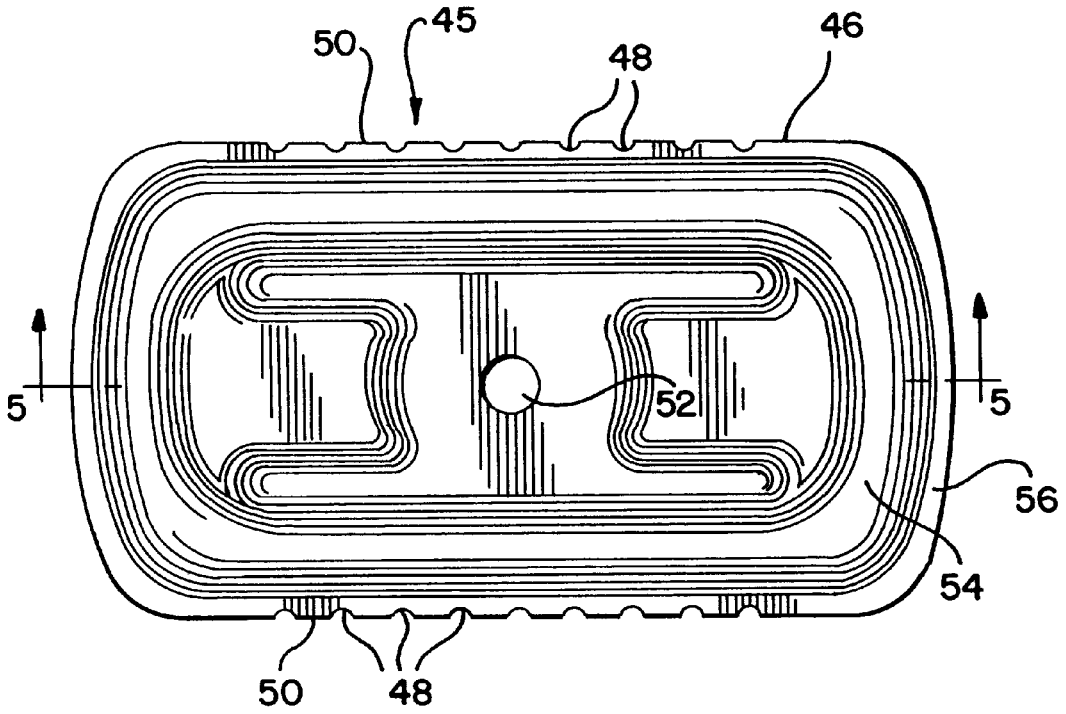
FIG. 7 PRIOR ART
FIG. 7 is a top view of a prior art roofing plate.
Figure 8:
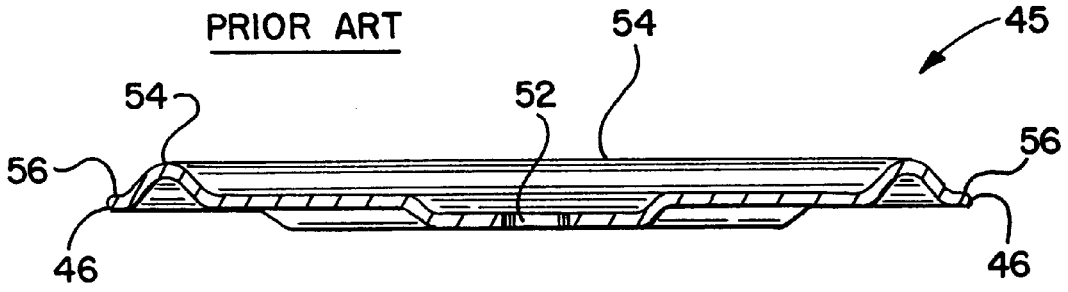
FIG. 8 PRIOR ART
FIG. 8 is a sectional view taken along the line 8—8 of FIG. 7 and in the direction indicated generally.

Referring now to FIGS. 7 and 8, the prior art gripping element disclosed in U.S. Pat. No. 5,797,232 to Larson is generally designated at 45. The Larson gripping element 45 is a generally planar plate with an oblong peripheral edge 46 which has a plurality of notches 48 spaced apart along the longer two sides 50 (best seen in FIG. 4). The notches 48 are configured to increase friction between the sides 50 and the membrane 18 to prevent the membrane from slipping relative to the gripping element 45. An opening 52 is generally centrally located on the plate for receiving a fastener (not shown), and an upwardly protruding rib 54 is formed between the peripheral edge 46 and the opening. The rib 54 provides support to the gripping element 45 to prevent it from bending. Also provided on the gripping element 45 is a lip 56 which extends from the rib 54 to the peripheral edge 46.

Compared to the gripping element 45 of Larson, which has a 2 inch width and weighs approximately 45.7 grams, the present plate 10 has a significantly narrower width of approximately 1.5 inches and a lighter weight of 36.3 grams. This translates into a savings of approximately 21 percent in material used in producing the present plate 10 versus the gripping element 45 of Larson. The gripping element 45 also does not have the above-described secondary ribs 38 which provide additional longitudinal reinforcement to the plate 10, or the flared corners 36 which prevent the lip 34 from cutting into the membrane 18 as in the present plate 10. Further, the gripping element 45 does not included the dimples 42, which keep the longer or major sides 22 in parallel with the edge of the roofing membrane 18 during installation, so that the formations 24 formed on the longer sides are allowed to grip the membrane 18 as the plate 10 is rocked onto its longer side.

It will be appreciated that a significant advantage of the present roofing plate is that it requires less material to produce than some prior art roofing plates, without sacrificing strength. Another advantage of this invention is that the corners are flared to prevent the roofing membrane from tearing. Yet another advantage of the invention is that it is provided with a pair of dimples which keep the longer sides of the plate parallel with the edge of the roofing membrane.

While various embodiments of the roofing plate of the invention have been shown and described, it will be appreciated by those skilled in the art that changes and modifications may be made thereto without departing from the invention in its broader aspects and as set forth in the following claims.

What is claimed is:

1. A roofing plate for securing a roofing membrane to a roof, comprising:

a top surface, a bottom surface and a generally oblong peripheral edge having two major sides and two minor sides;

an opening located generally centrally on said plate in a central portion for receiving a fastener for securing said plate to the roof;

a plurality of gripping formations formed on said peripheral edge for preventing slippage of the roofing membrane relative to said plate;

a pair of first rib portions projecting from said top surface respectively along at least each of said two major sides between said peripheral edge and said central opening; and a pair of transverse ribs projecting from said top surface for enhancing torsional stability and reinforcing said central portion of said plate, said transverse ribs each being positioned to form a generally I-shaped portion with said pair of first rib portions.

2. The roofing plate as defined in claim 1 wherein said plurality of gripping formations are formed along at least a part of said two major sides of said peripheral edge.

3. The roofing plate as defined in claim 2 wherein said gripping formations are a plurality of notches cut into said peripheral edge.

4. The roofing plate as defined in claim 1 wherein said pair of first rib portions project higher near said central opening than near said corners.

5. The roofing plate as defined in claim 1 wherein said pair of said first rib portions are connected to each other along said minor sides between said peripheral edge and said central opening to extend continuously along said peripheral edge.

6. The roofing plate as defined in claim 5 further including a pair of second rib portions projecting upwardly from said first rib portions along said central portion for assisting said first rib portions in preventing said plate from bending at said central portion.

7. The roofing plate as defined in claim 1 wherein said transverse ribs extend transversely on each side of said opening between said first rib portions.

8. The roofing plate as defined in claim 1 wherein said plate has corners which are flared upwardly to prevent said corners from tearing the roofing membrane.

9. The roofing plate as defined in claim 8 wherein said corners are flared upwardly at an angle from approximately 4 degrees to 16 degrees.

10. The roofing plate as defined in claim 9 wherein said corners are flared upwardly at an angle of approximately 5 degrees.

11. The roofing plate as defined in claim 1 further including a pair of dimples protruding from said bottom surface on each side of said opening.

12. The roofing plate as defined in claim 11 wherein said dimples have a generally conical configuration.

13. A roofing plate for securing a roofing membrane to a roof, comprising:

a top surface, a bottom surface and a generally oblong peripheral edge having a pair of major sides and a pair of minor sides;

an opening located generally centrally on said plate for receiving a fastener for securing said plate to the roof;

a pair of first rib portions projecting from said top surface respectively along said pair of said major sides between said peripheral edge and said opening; and upwardly flared corners for preventing said peripheral edge at said corners from cutting the roofing membrane.

14. The roofing plate as defined in claim 13 wherein said pair of first rib portions project higher near said central opening than near said corners.

15. The roofing plate as defined in claim 13 wherein said pair of said first rib portions are connected along said minor sides between said peripheral edge and said central opening to extend continuously along said peripheral edge.

16. The roofing plate as defined in claim 15 further including a pair of second rib portions projecting upwardly from said first rib portions along a central portion of said plate for assisting said first rib portions in preventing said plate from bending at said central portion.

17. The roofing plate as defined in claim 13 wherein said corners are flared upwardly at an angle from approximately 4 degrees to 16 degrees.

18. The roofing plate as defined in claim 17 wherein said corners are flared upwardly at an angle of approximately 5 degrees.

19. The roofing plate as defined in claim 13 further including a pair of transverse ribs projecting from said top surface on each side of said opening for enhancing torsional stability and reinforcing a central portion of said plate.

20. The roofing plate as defined in claim 13 further including a plurality of gripping formations formed along at least a part of said two major sides of said peripheral edge for preventing slippage of the roofing membrane relative to said plate.

21. The roofing plate as defined in claim 13 further including a pair of dimples protruding from said bottom surface on each side of said opening.

22. The roofing plate as defined in claim 21 wherein said dimples have a generally conical configuration.

23. A roofing plate for securing a roofing membrane to a roof, comprising:

a top surface, a bottom surface and a generally oblong peripheral edge having two major sides and two minor sides;

an opening located generally centrally on said plate for receiving a fastener for securing said plate to the roof;

a first rib portion projecting from said top surface between said peripheral edge and said opening and having a shape generally corresponding to said peripheral edge; and at least one second rib portion formed on said first rib portion along a central portion of said plate, for assisting said first rib portion in preventing said plate from bending at said central portion.

24. The roofing plate as defined in claim 23 wherein said second rib portion projects from said first rib portion on each side of said central opening.

25. The roofing plate as defined in claim 23 further including a plurality of gripping formations formed along at least a part of said two major sides of said peripheral edge for preventing slippage of the roofing membrane relative to said plate.

26. The roofing plate as defined in claim 23 further including a pair of transverse rib projecting transversely from said top surface on each side of said opening for enhancing torsional stability and reinforcing a central portion of said plate.

27. The roofing plate as defined in claim 23 further including a lip extending between said first rib portion and said peripheral edge, said lip being flared upwardly at each corner of said plate for preventing said peripheral edge at said corners from cutting the roofing membrane.

28. The roofing plate as defined in claim 23 further including a pair of dimples protruding from said bottom surface on each side of said opening.

* * * * *